US006910972B2

(12) United States Patent
Norbury

(10) Patent No.: US 6,910,972 B2
(45) Date of Patent: Jun. 28, 2005

(54) REAL-SIZE SIMULATED PNEUMATIC DRAG STRIP RIDE

(76) Inventor: Steven Norbury, 938 Wheat Ridge, Troy, IL (US) 62294

( * ) Notice: Subject to any disclaimer, the term of this patent is extended or adjusted under 35 U.S.C. 154(b) by 0 days.

(21) Appl. No.: 10/388,557

(22) Filed: Jun. 24, 2003

(65) Prior Publication Data

US 2004/0266540 A1 Dec. 30, 2004

(51) Int. Cl.[7] ..... A63K 1/00
(52) U.S. Cl. ..... 472/85; 104/60; 104/77
(58) Field of Search ..... 472/85, 88, 89; 104/53, 60, 77, 78

(56) References Cited

U.S. PATENT DOCUMENTS 3,410,223 A * 11/1968 Miller ..... 104/60
4,920,890 A * 5/1990 Barber ..... 104/53
4,991,514 A * 2/1991 Powell et al. ..... 104/60
5,361,705 A * 11/1994 Powell ..... 104/60
5,522,321 A * 6/1996 Mosley et al. ..... 104/60
5,551,347 A * 9/1996 Gutknecht ..... 104/53
6,176,788 B1 * 1/2001 Checketts ..... 472/43
6,227,120 B1 * 5/2001 Fritz ..... 104/60
6,397,755 B1 * 6/2002 Kamler ..... 104/53

* cited by examiner

*Primary Examiner*—K. T. Nguyen
(74) *Attorney, Agent, or Firm*—Don W. Weber

(57) ABSTRACT

A real-size simulated drag strip ride is presented which recreates the physical and visual sensations of a drag race. A pair of real-size dragsters are positioned along specified and controlled parallel linear tracks. The occupant is positioned inside the driver's compartment, with a full safety harness securing him in place in an adjustable seat. The invention includes audio sounds of ignition, "burn-out" and acceleration simulating a drag strip race, as well as simulated smoke from the "burn out" portion of the race preparation. Once the simulated light tower signals that the dragster is set to race, each driver of two, side-by-side vehicles pushes the acceleration pedal to accelerate the vehicle through an initial acceleration zone. The dragsters are propelled by use of a pneumatically powered piston attached to a cable located out of sight underneath the vehicle. The race is finished when the cars pass the finish line. Speeds and the winner are displayed on the starting line tower. The cars are then returned to the loading and unloading area for the next riders.

7 Claims, 12 Drawing Sheets

REAL-SIZE SIMULATED PNEUMATIC DRAG STRIP RIDE

BACKGROUND OF THE INVENTION

This invention pertains to the field involving amusement rides and drag racing. More particularly this invention describes a simulated, real time, pneumatically powered, real effect drag strip race. This drag strip race may be a stand-alone amusement ride located in population centers or other amusement areas such as parks. This amusement ride is also well adapted to theme parks or amusement parks. These theme parks or amusement parks are located throughout the United States and the world. Such amusement parks are located in England, France, Germany, Russia, and even China. Actual drag strip races are common in the United States and throughout the rest of the world. This particular invention discloses a stimulated drag strip ride for use by the paying public.

Amusement rides are often simulations of much more dangerous real life rides or adventures. Many examples of these real life amusement rides have been created at large and small amusement parks across the United States and the world. Some examples include roller coaster rides, bumper car rides, airplane rides and go-cart rides. These rides often attempt to simulate the actual, true-life experience and create many of the same visual and physical sensations associated with those real life rides.

One type of real life race in which the average person is not allowed to participate directly due to the dangers involved is the drag race. A drag race comprises two highly powered cars located side-by-side on parallel tracks. When a signal tower is illuminated both drivers of the dragsters accelerate their cars in order to reach the finish line first. The signal tower allows spectators to see the actual winner as well as to see the times that have been posted. These dragster automobiles have high-powered gasoline engines and often accelerate to speeds in excess of 175 miles per hour. This acceleration causes G-forces to be exerted on the driver and any passengers in the dragster. In addition, the noise and exhaust of the dragsters contribute to the real life sensation of the race.

It is an object of this invention to create a real-size simulated drag strip race that reproduces the physical and visual sensations of an actual race. Accordingly, it is an object of this invention to simulate acceleration that will apply G-forces to the passenger and driver of the dragster. It is a further object of this invention to create both the sights and sounds of the drag race and to simulate the visual appearance of the dragster, racecourse and finish line.

Many amusement rides involve high velocity, dangerous curves and other safety hazards. However, since these rides are designed for laymen, rather than professional riders, safety enhancements and special features of any such ride must be included in the basic design package of any amusement ride. It is a further object of this invention to provide various safety devices, such as harnesses, brake systems, guide rails and other safety features to enable a driver and passenger to simulate a real drag strip race while still being completely safe.

Due to the new and unique nature of this particular simulated drag strip race, many innovations and special design features have been incorporated into the below described Specification in order to closely simulate a real life dragster race and to make it safe and exciting to use.

BRIEF DESCRIPTION OF THE PREFERRED EMBODIMENT

This particular ride is designed to recreate a dragster race to simulate the actual dragster experience. The dragster vehicle is designed to look like the well-known funny car, dragster or other racecar. The simulated dragster will have the same appearance of a regular dragster, and will have the same size and body construction as a real vehicle. The drag strip ride consists of at least two vehicles on separate, side-by-side tracks, with a parallel straight track of about 600 feet. A sophisticated, highly redundant control system utilizes multiple locks to keep vehicles separated during the ride. The vehicles appear to ride on upper, simulated wheels. However, the vehicle actually rides on lower actual wheels. The vehicles in the preferred embodiment are powered by a pneumatic system and can achieve speeds of up to 125 to 250 miles per hour, creating approximately 3.5 to 4.5 Gs of force on the driver and passenger of the dragster. The racecourse is laid out like a real drag strip, having a light tower at the finish line. The dragster itself is started and accelerated by the driver. For safety reasons, individual adjustable seats and harnesses are provided.

BRIEF DESCRIPTION OF THE DRAWING FIGURES

Figure 10:
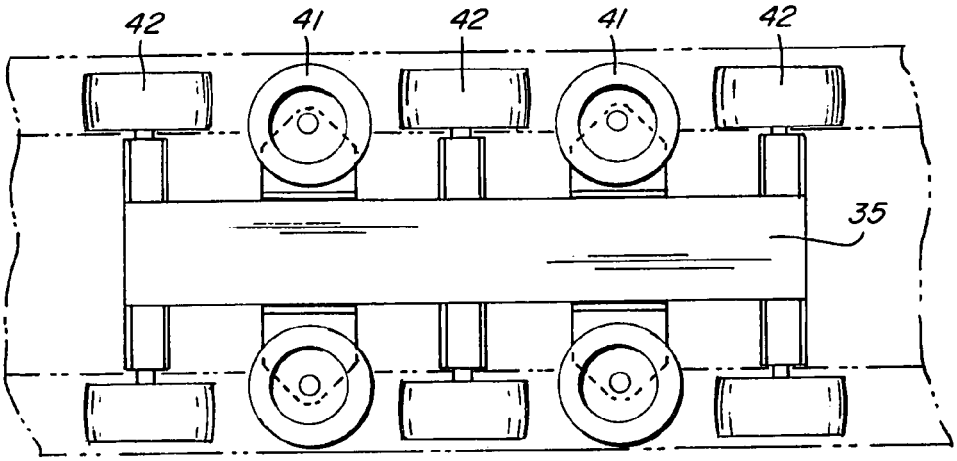
FIG. 10 is a cutaway plan view of the horizontal and vertical caster arrangement of one embodiment of the invention.
Figure 10A:
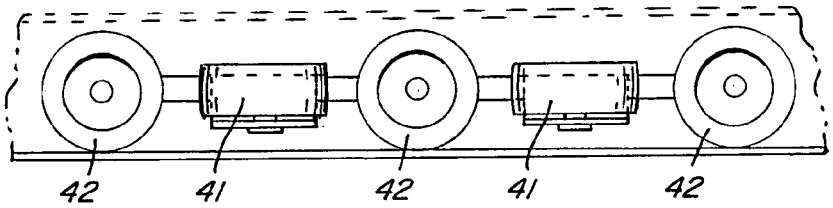

FIG. 10*a* is a side view of the horizontal and vertical caster arrangement of one embodiment of the invention.

Figure 11:
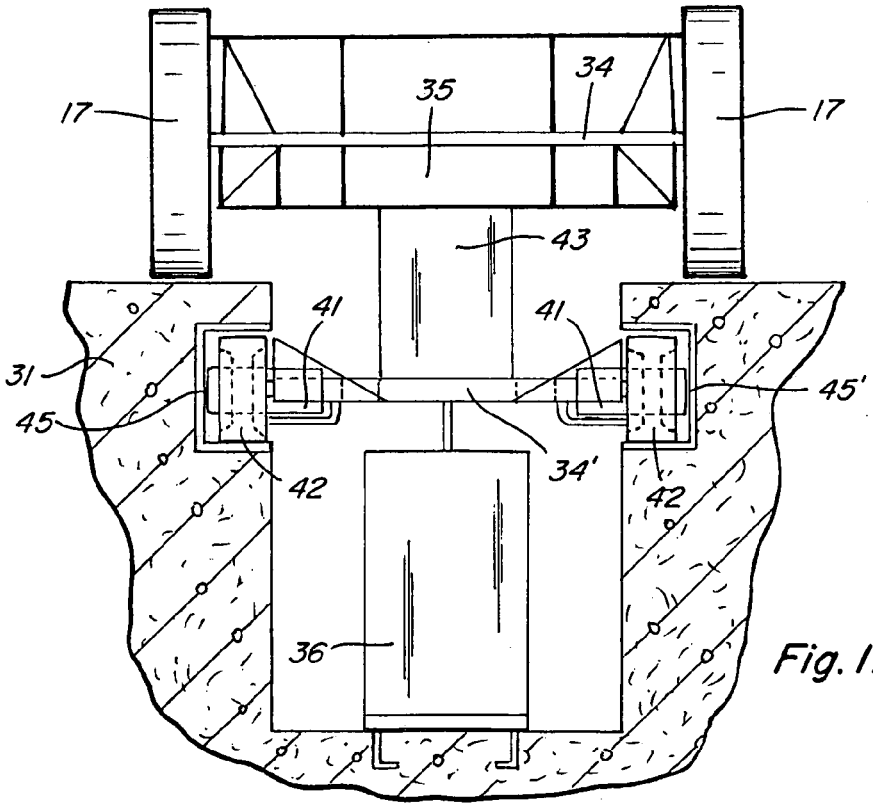

FIG. 11 is a front cutaway view of the track showing one below ground embodiment of the invention.

Figure 12:
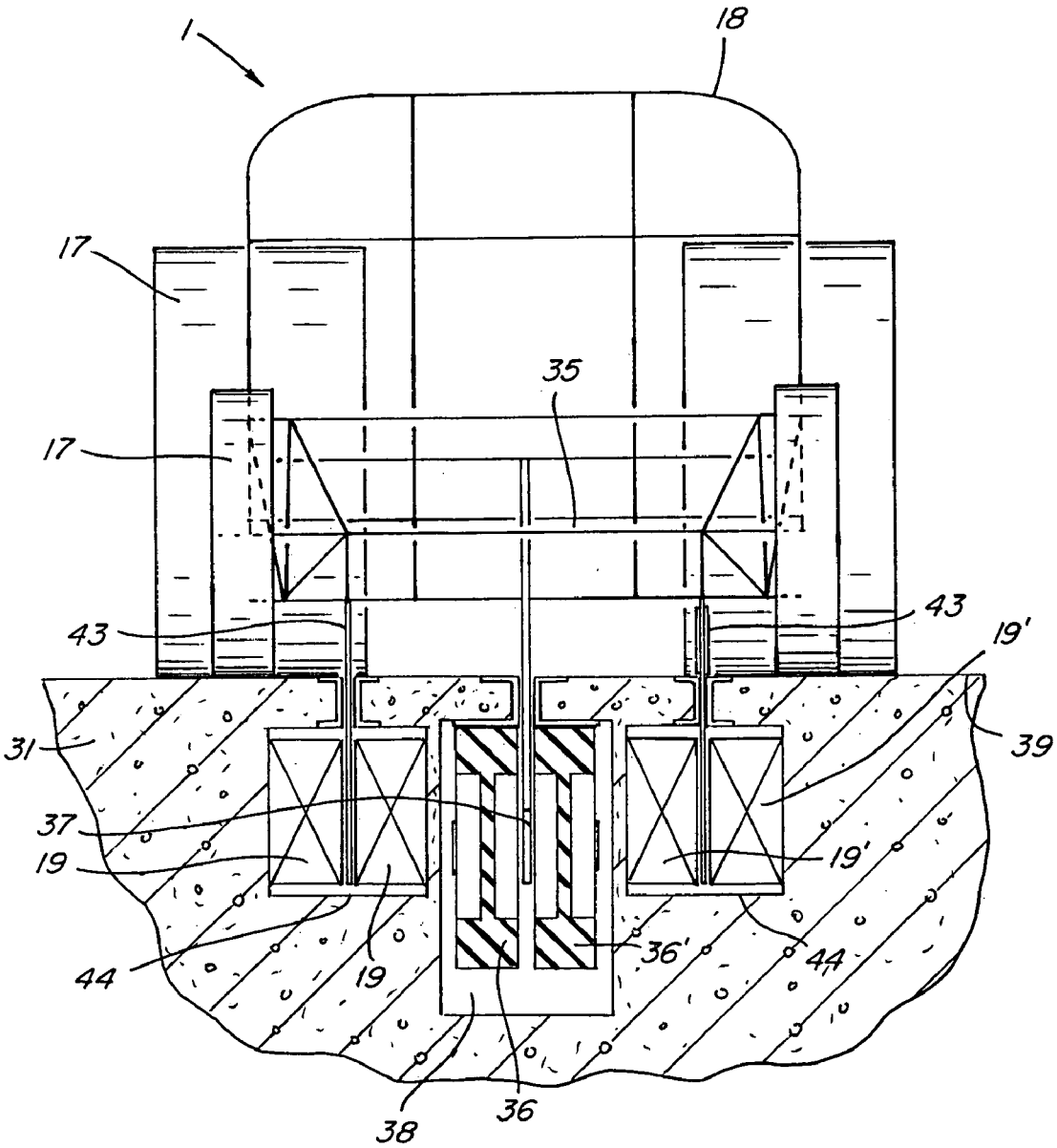

FIG. 12 is a front cutaway view of another below ground embodiment of the invention.

Figure 13:
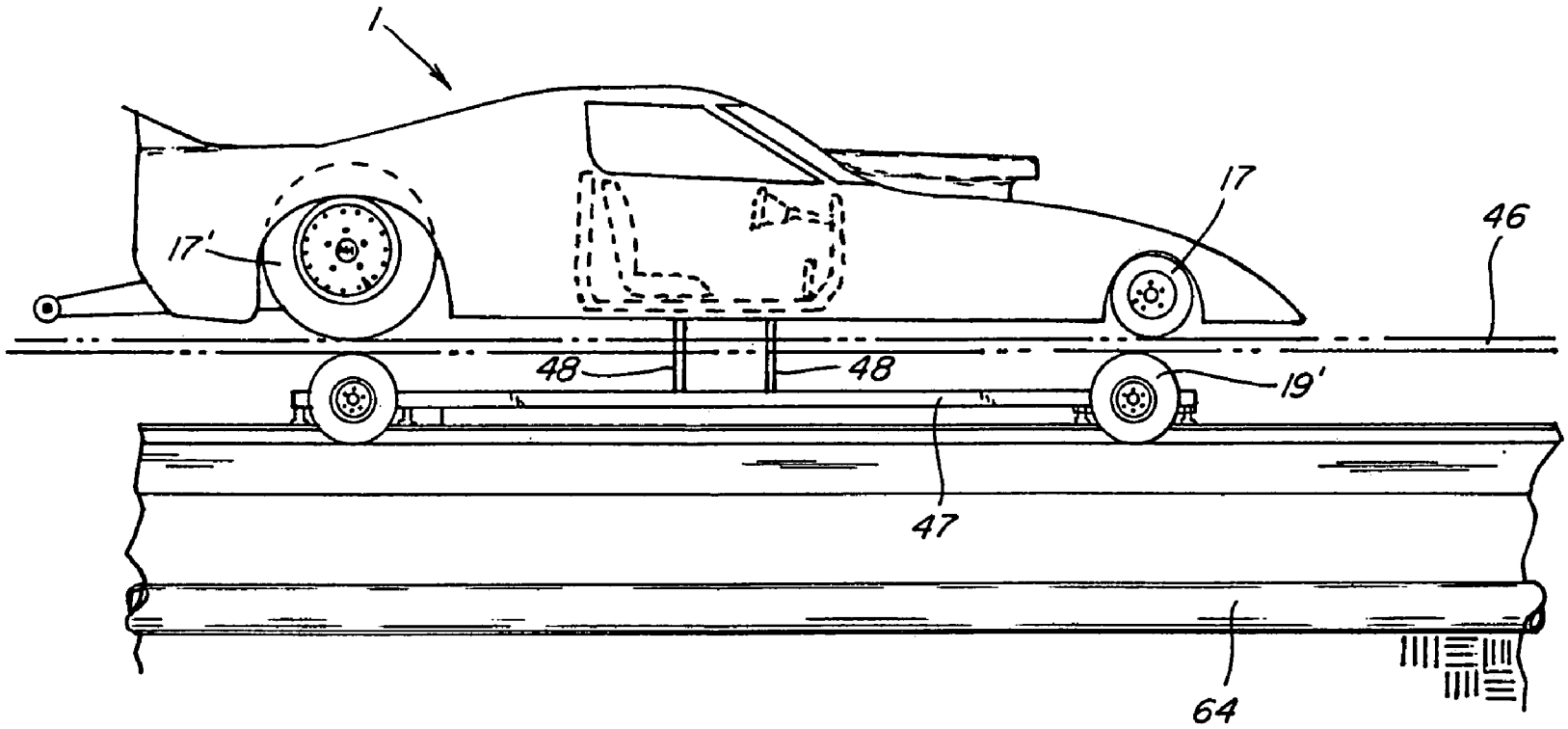

FIG. 13 is a side view of the racecar and track of the pneumatic embodiment of this invention.

Figure 14:
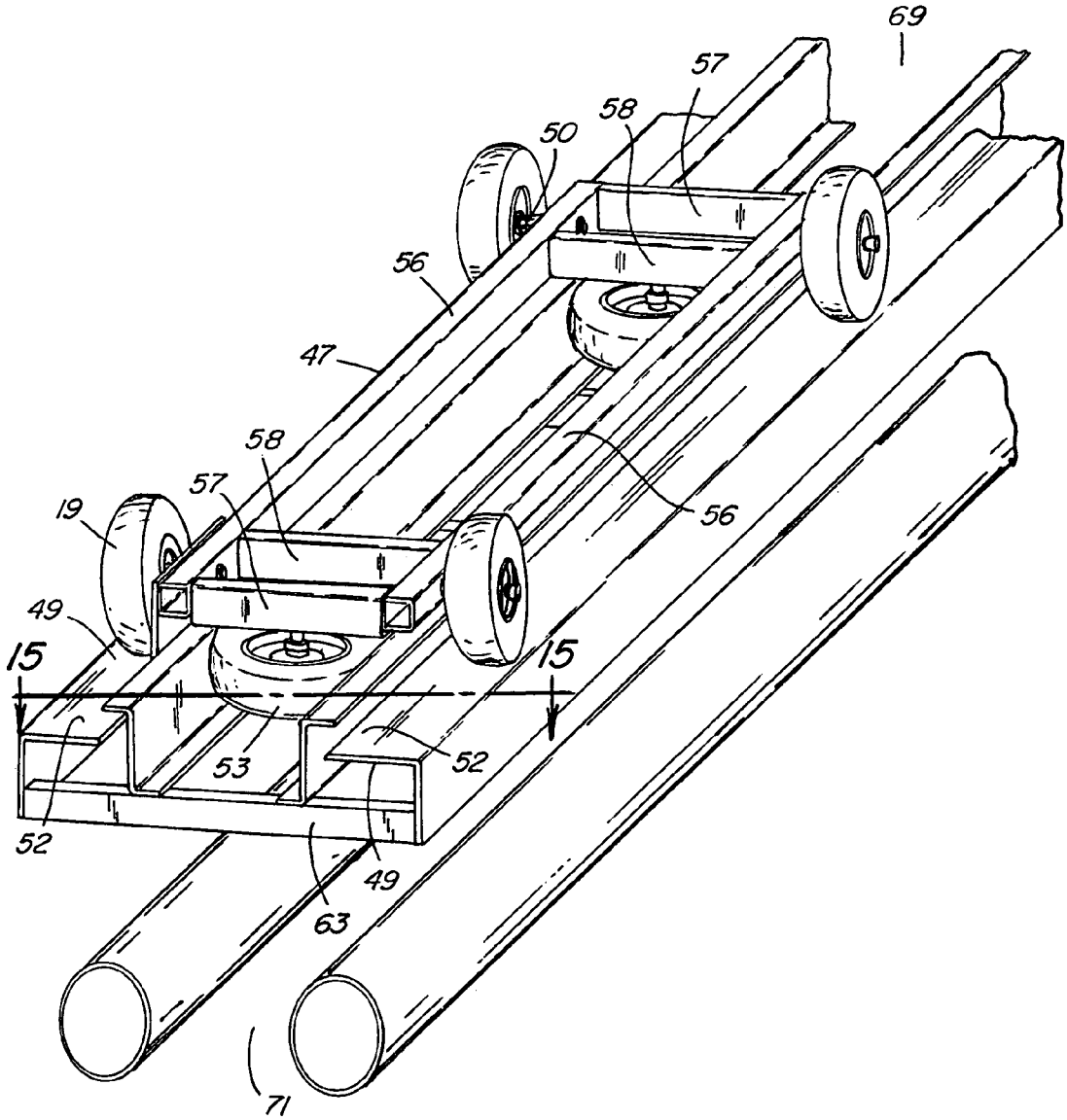

FIG. 14 is a perspective cutaway view of the track and base of the car of the pneumatic embodiment of this invention.

Figure 15:
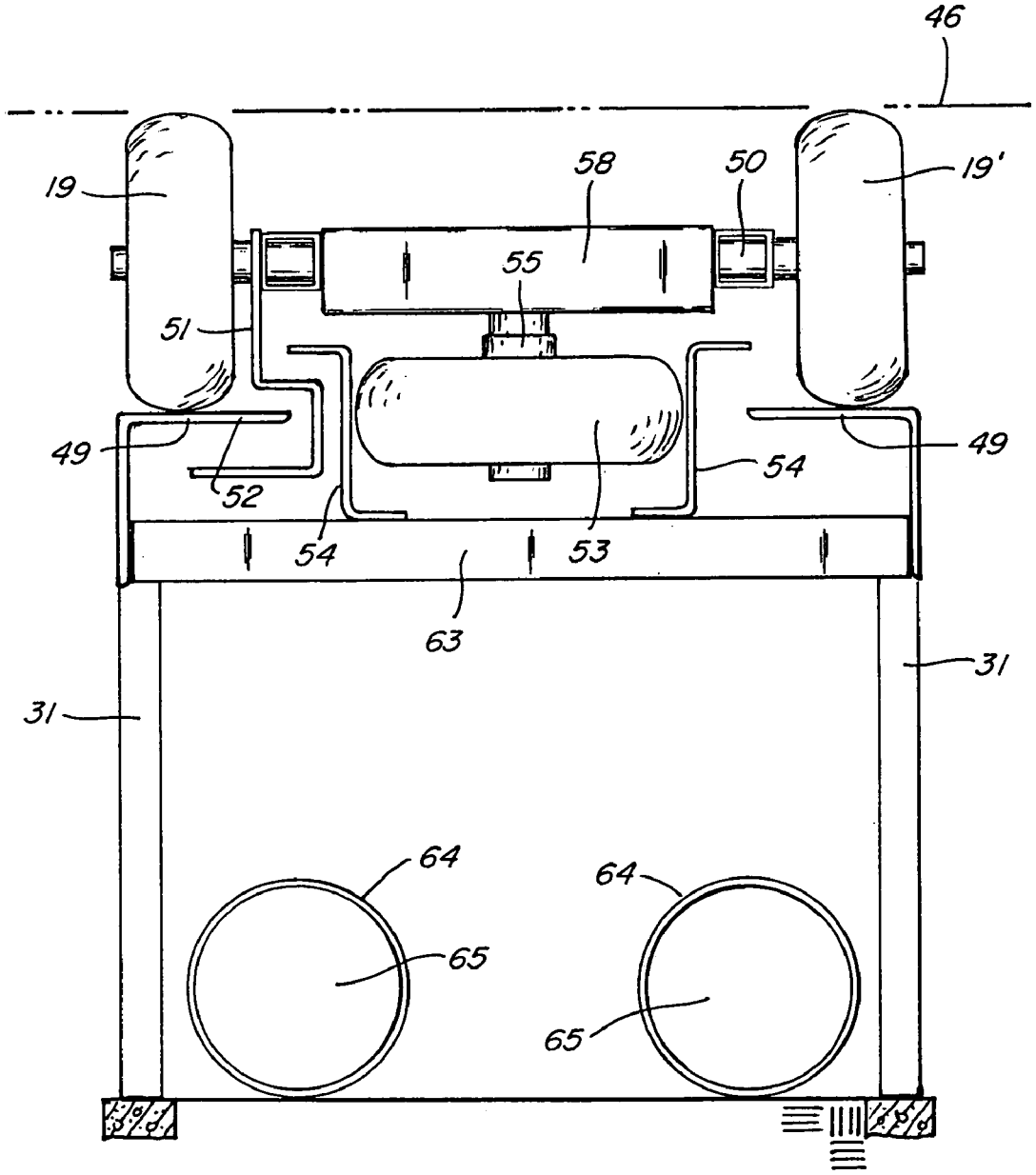

FIG. 15 is a front view taken along lines 15—15 of FIG. 14 of the pneumatic embodiment of this invention.

Figure 16:
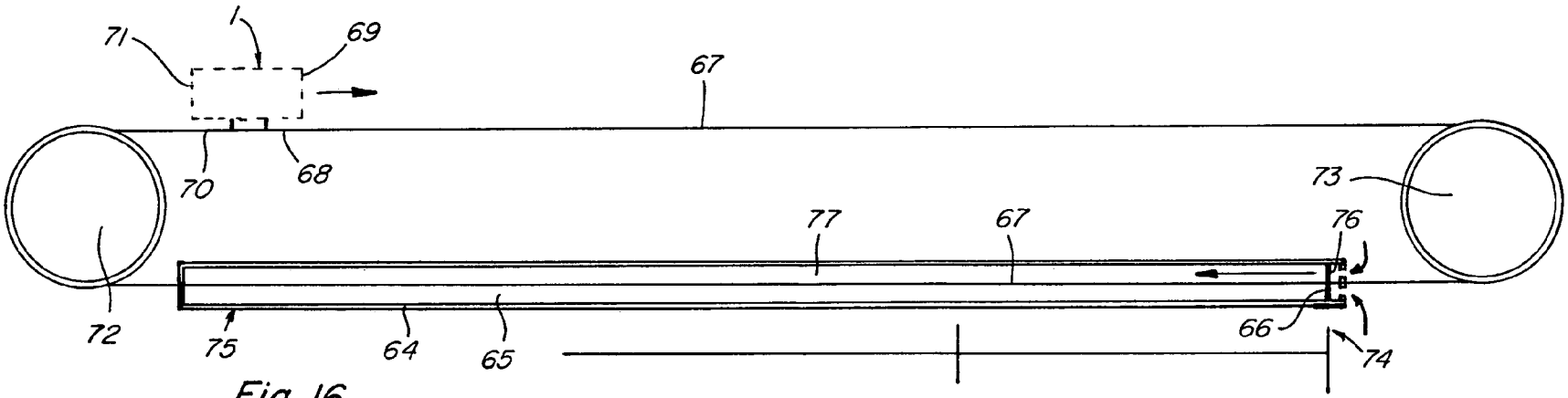

FIG. 16 is side cutaway view of the pneumatic embodiment of this invention, showing the piston and cable system of propulsion at the start of the race.

Figure 16A:
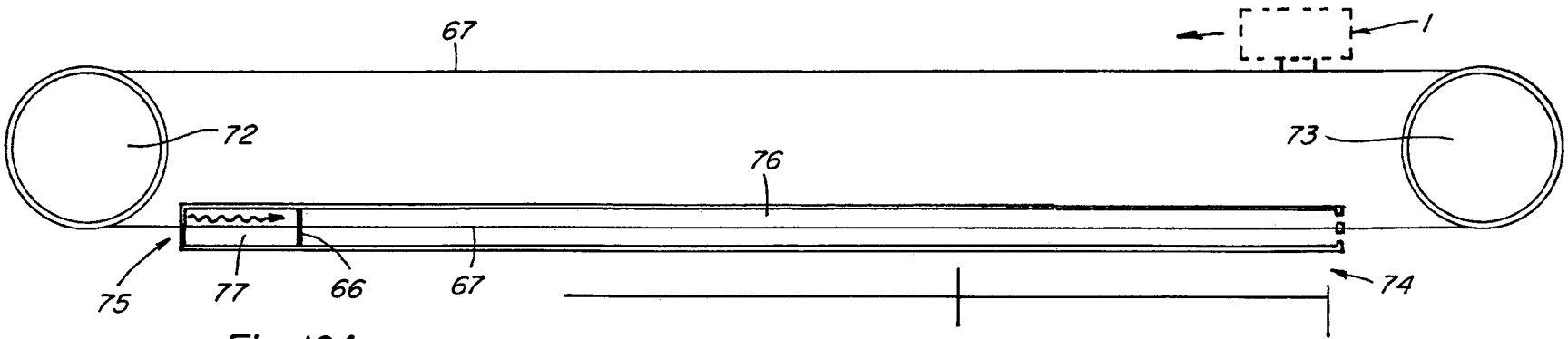

FIG. 16A is a side view of the pneumatic embodiment of this invention, showing the piston and cable near the end of the race.

Figure 17:
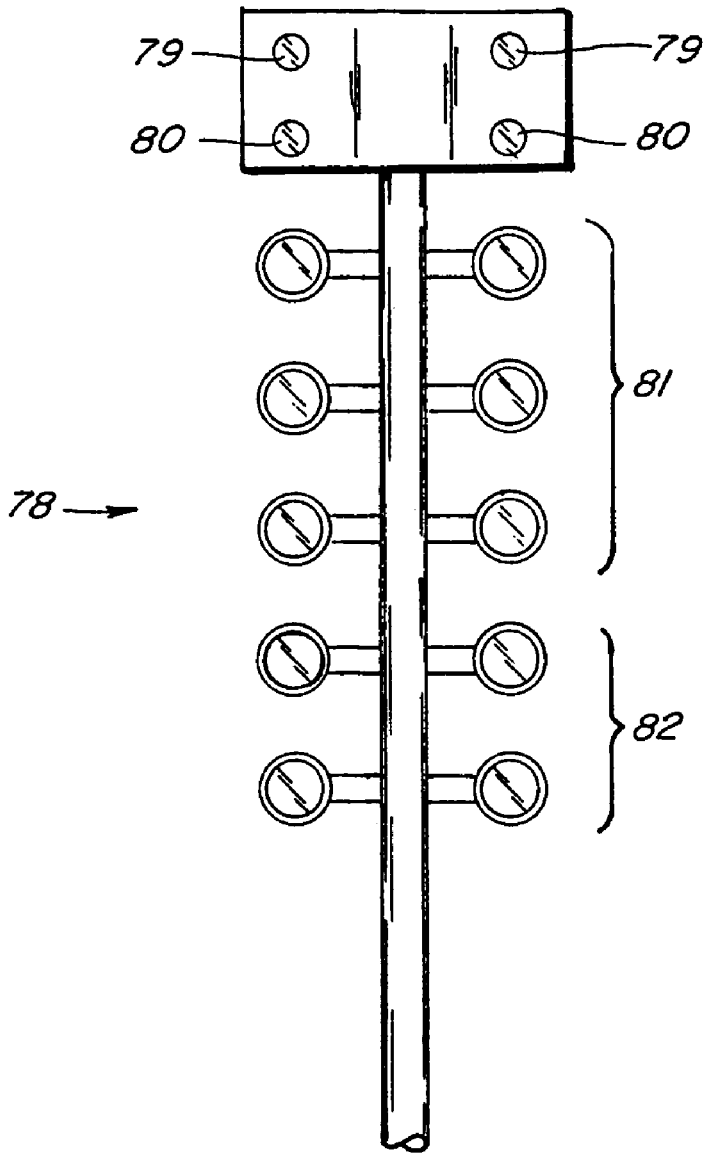

FIG. 17 is a depiction of the "Christmas tree" signal lighting system used in practicing this system.

DETAILED DESCRIPTION OF THE PREFERRED EMBODIMENT

Figure 1:
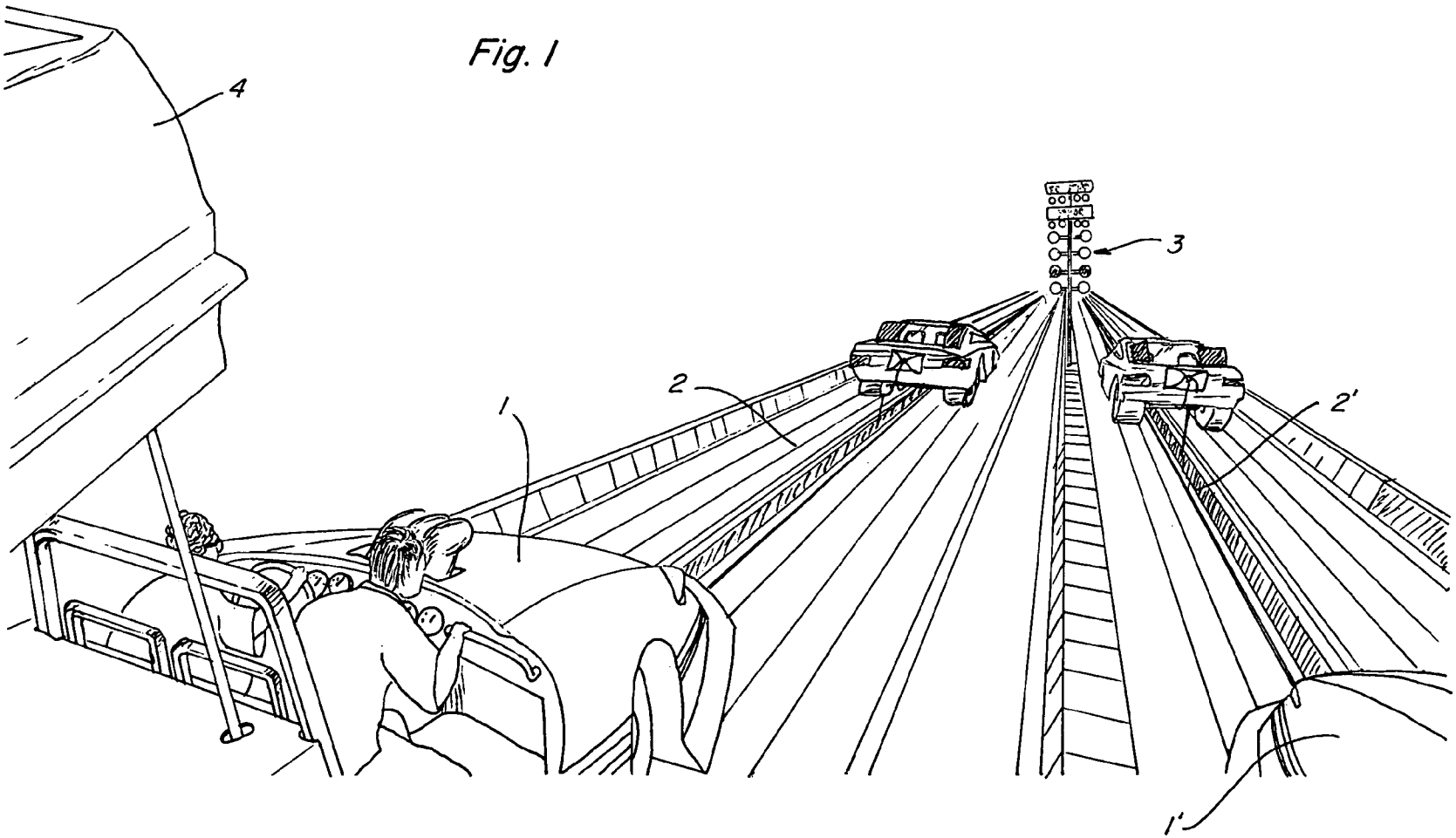
FIG. 1 is a perspective view of the drag race showing the side-by-side parallel tracks and the light tower and start line.
Figure 2:
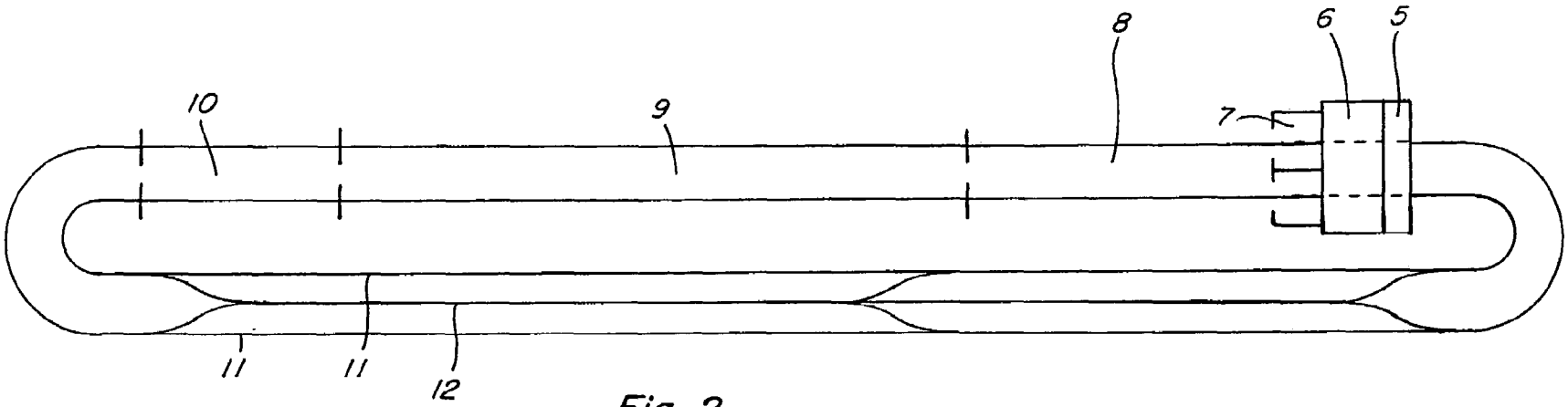
FIG. 2 is a plan view of the drag race strip and return track.

A real size, simulated dragster race includes an essentially oval raceway with two side-by-side parallel acceleration strips as best shown in FIGS. 1 and 2. Left 1 and right 1' simulated dragsters are located on left 2 and right 2' parallel tracks. The race runs for approximately ⅛ of a mile from start to finish in a first embodiment. At the starting line is a signal tower 3. This starting line signal tower has a number of lights such as are usually found in a real life drag race. The lights include a set of green lights to signal "go", a set of yellow lights to signal "ready" and an electronic readout to signify the winner and the speeds at which each simulated dragster proceeded down the track. Different light systems can be used in practicing this invention.

Figure 3:
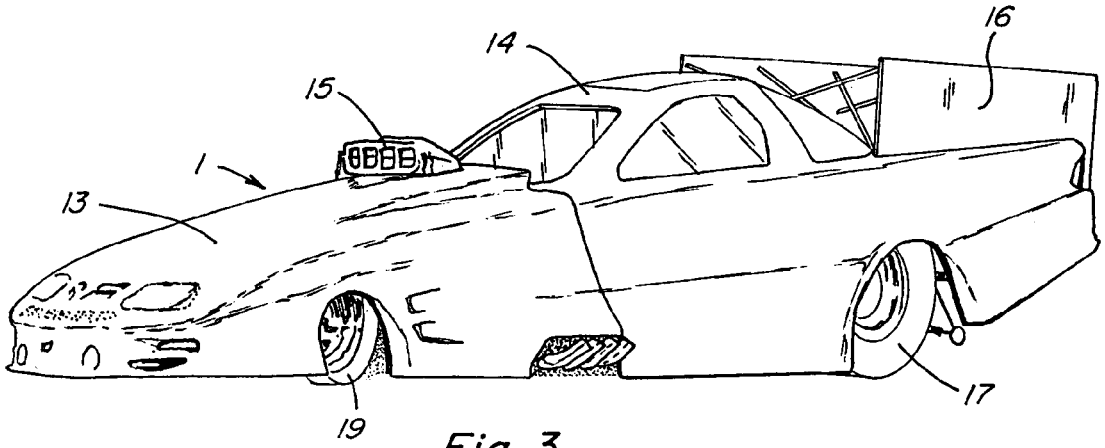
FIG. 3 is a perspective view of the simulated dragster body.

Each dragster has an upper, pivotable top 4. This pivotable top 4 moves upwardly (as shown in FIG. 1) to allow passengers to enter the vehicle. The dragster top 4 is then closed (as shown in FIG. 3) for the duration of the ride.

The entire simulated drag strip ride may consist of an essentially oval course as best shown in FIG. 2. The main part of the oval course includes an unloading area 5, an instructional area 6 and a loading area 7. These particular areas are used to unload passengers, to instruct passengers on the proper operation of the ride and an area in which passengers may be loaded.

After the passengers are loaded in area 7, the ride is commenced. One passenger in each vehicle is allowed to control the take off of the dragster. The traditional signal tower lights at the starting line of the track commence the take off. Acceleration starts with a push of the accelerator pedal by the driver of the simulated dragster. Simulated shifting is accomplished by a push button also operated by the driver.

The dragster is accelerated for approximately 185 feet in an acceleration area 8. Each dragster may accelerate to approximately 125 to 250 miles per hour, during which each driver and passenger would experience a force reaching approximately 3.5 to 4.5 Gs. Once each dragster has accelerated through the acceleration area 8, the dragsters enter a coasting area 9 (approximately 260 feet) and a braking area 10 (approximately 260 feet). In the braking area, the dragster is automatically decelerated through means to be described later. The total length of the drag race from the loading area to the finish line is approximately ⅛ of a mile.

When the ride is finished, each simulated dragster slowly moves through the curved area and back onto the return tracks 11. A middle maintenance track 12 is also provided for maintenance of the vehicle if desired. Once the dragsters return to the unloading area 5, passengers are unloaded and the ride is completed.

Figure 4:
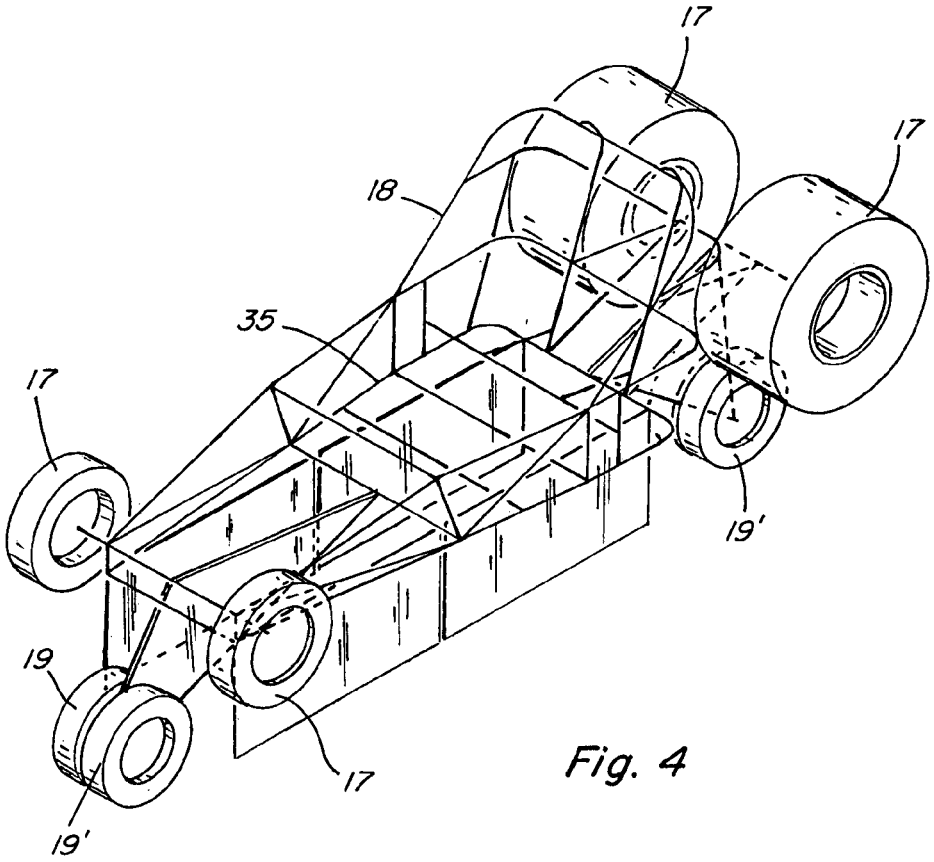
FIG. 4 is a perspective view of one embodiment of the dragster frame, including the simulated and actual wheels and the lower frame portions of the dragster.

In order to closely simulate a real life drag race, dragsters or "funny car" designs are adopted. One such design is best shown in FIG. 3. It is to be noted that the dragsters themselves may take on any design desirable, from drag race type cars to stock cars, to Indy cars. A typical dragster design would include a front, upper body 13 and a rear body 14. The rear body 14 may be raised in order for riders to enter the car at the loading area 7. However, when the car is in motion, the rear 14 of the body is in its closed and secured position as best shown in FIG. 3. To simulate an actual dragster, a cowl 15 and a spoiler 16 may also be incorporated into the outer appearance of the dragster. The simulated portion of the dragster is completed with the addition of simulated track wheels 17, as shown in FIGS. 3 and 4. These simulated track wheels actually contact the track and may visually be observed by the driver and spectators of the simulated drag race.

The front 13 and rear 14 portions of the outer body of one embodiment of the dragster are supported by frame supports 18, as best shown in FIG. 4. These frame supports 18 are preferably made of a strong yet lightweight metal. The dragster body itself may be made of fiberglass using a biaxial cloth with a modified vinyl ester resin. This fiberglass body and frame insures a lightweight dragster with superior strength.

Although the observer is able to see only the simulated track wheels 17, the vehicle really rides on actual rubber or metal wheels 19 and 19' (FIGS. 4 and 12) or casters 33 and 33' (FIGS. 8–11). In the preferred embodiment, a set of front wheels 19 and 19' and a set of rear wheels support the weight of the dragster as it moves down the track.

Figure 5:
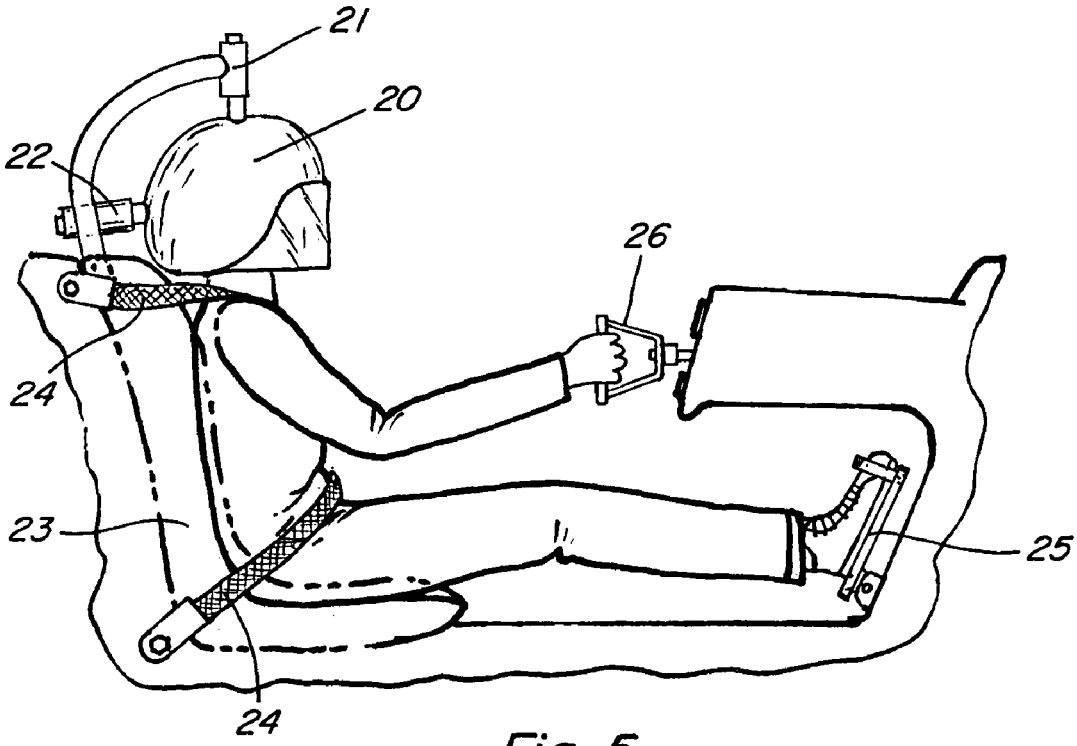
FIG. 5 is a side cutaway view of the driver compartment of the dragster.

As shown in FIG. 5, a number of unique safety features are incorporated into this particular ride in order to insure the safety of the driver and passenger of the simulated drag strip race. These safety features include an adjustable helmet 20. This adjustable helmet has a vertical adjustment member 21 and a horizontal adjustment member 22. These adjustment members allow the attendant of the ride to adjust the helmet of the driver or passenger of the dragster according to his or her particular size. In addition, an adjustable seat 23 moves upward and forward, depending on the size of the driver or passenger. Finally, a Y-shaped safety seat harness 24 is provided for both the driver and the passenger of this drag strip ride. In normal amusement rides, a simple padded bar around the rider's waist would be utilized to keep the passenger in the ride. However, due to the special considerations in constructing a simulated drag strip race, a safety harness is incorporated into the overall design of the device.

The race begins when the starting line signal tower flashes green for "go". At that point, each of the two side-by-side dragster drivers will push the acceleration pedal 25. In real life this acceleration pedal feeds gasoline to the carburetor or fuel injectors of the engine. In this simulated ride, the acceleration pedal gives a signal to the linear induction motor, or other drive means to begin the race. A brake pedal (not shown on the drawing figures) is also provided to decelerate the vehicle should such a procedure be necessary.

Figure 6:
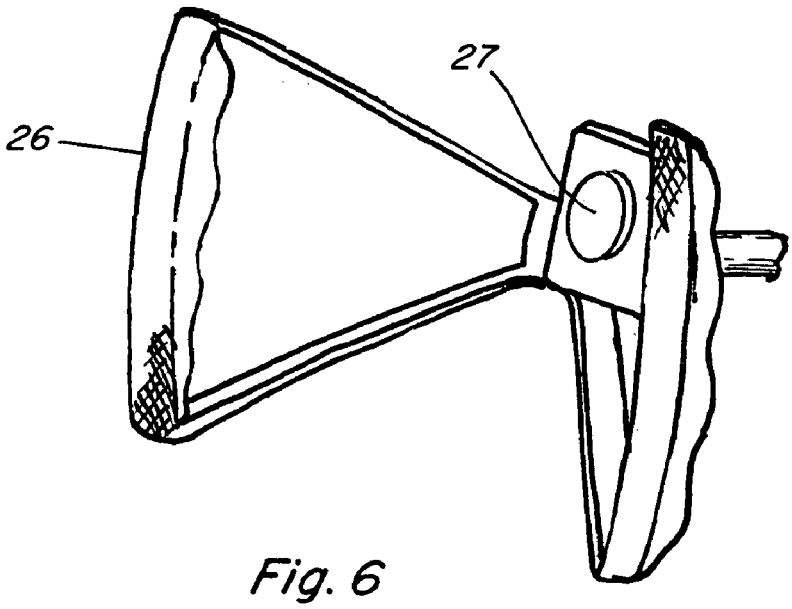
FIG. 6 is a side view of the steering wheel and shift button.

The dash panel of the vehicle also includes a steering wheel 26. Although the steering wheel is included for purposes of making the ride realistic, the vehicle actually rides on a straight and clearly defined track. While no steering of the vehicle is actually necessary or desirable, the presence of the steering wheel is used to enhance the realism of the device. However, buttons 27 and 27' are present on the instrument panel, as best shown in FIG. 6. These buttons could simulate the actual shifting done in a dragster in real life, or could be used as simulated ignition or "ready" buttons. The use of these buttons is described later herein. Using the linear induction motor means of accelerating the vehicle, simulating shifting can be readily incorporated as a feature of this ride. Such a simulated shifting is described later.

Figure 7:
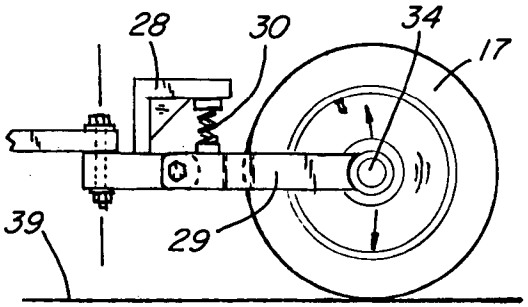
FIG. 7 is a partial side view of the simulated wheel.

As previously noted, the dragster itself rides on actual wheels 19 and 19', which are hidden from the view of the spectators or riders of the vehicle. However, in order to provide a realistic depiction of the actual ride, simulated wheels 17 are provided on the front and rear of the vehicle. These simulated wheels 17 are held in contact with the upper track surface 39 by means of a wheel strut bracket 28 and a wheel strut spring 30. This bracket and spring bias the simulated wheel strut 29 downwardly towards the track surface 39, as best shown in FIG. 7. Each left and right front and rear simulated wheel 17 has such a spring mechanism.

Figure 8:
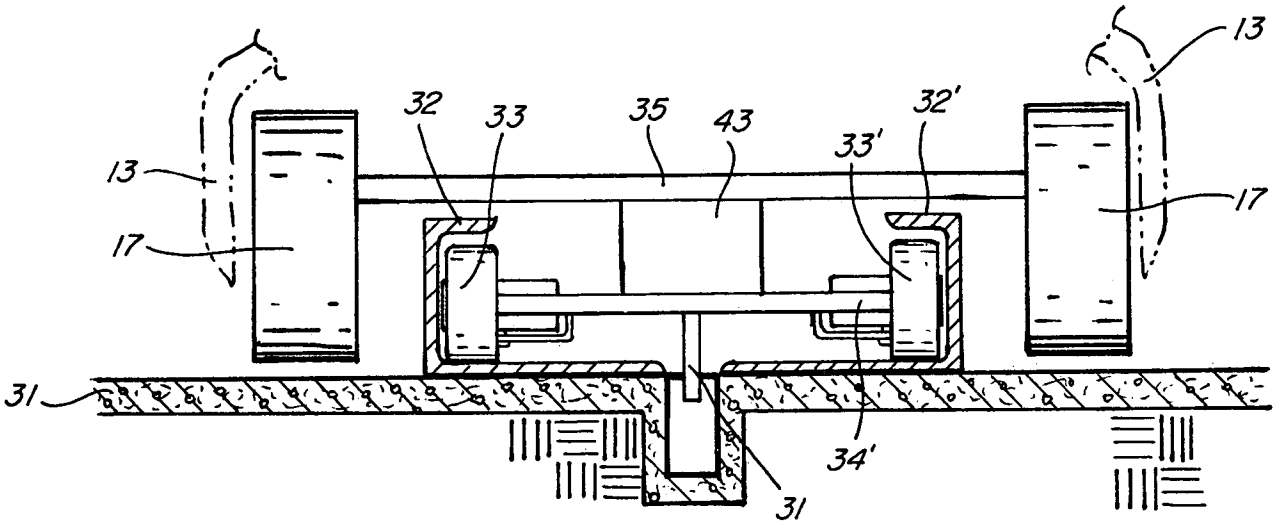
FIG. 8 is a front cutaway view of another embodiment of the above ground embodiment of the dragster raceway.
Figure 9:
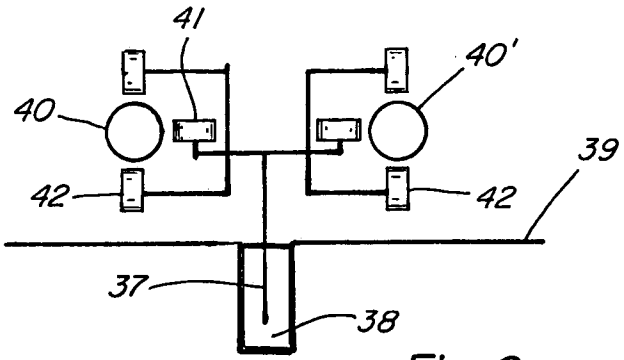
FIG. 9 is a schematic view of a rail and caster track embodiment of the invention.

Turning now to the linear track design, FIGS. 8 and 9 show two such above track embodiments.

FIG. 8 shows the basic concrete track 31. This concrete track 31 is normally comprised of concrete reinforced with approximately ½ inch rebar, as shown. Inside the simulated wheels 17 and underneath the dragster frame lower base 35 are side-by-side steel channel guide systems. These guide systems include a left channel 32 and a right channel 32'. These channels are generally C-shaped as shown, and face each other as illustrated in FIG. 8. The dragster frame lower base 35 is connected to an actual axle 34' by a dragster lower base frame-actual wheel connection column 43. The lower base frame 35 thus rides on the actual axle 34'.

The actual axle 34' is connected to a series of casters, as best shown in FIGS. 8, 9, 10 and 10*a*. A left actual caster wheel 33 and a right actual caster wheel 33' are located vertically. Although the axle 34' does not turn, the caster wheels 33 and 33' do turn. The vehicle itself is accelerated in the preferred embodiment by a linear induction motor 36. While the actual axle 34' supports the weight of the vehicle and passengers, a simulated axle 34 (as shown in FIGS. 7 and 11) connects the left and right simulated wheels. However, as previously noted, these wheels are simulated wheels only and do not actually operate to move or drive the vehicle forward.

Turning to FIG. 12, the linear induction motor 36 and 36' is shown in one embodiment. This linear induction motor 36 and 36' creates a magnetic field in a reaction plate 37 that propels the vehicle down the track through the acceleration zone 8. In order to understand the acceleration means of the preferred embodiment, a brief discussion of electromotive accelerating means would be beneficial.

Rotary induction motors, often referred to as "squirrel cage motors," were invented decades ago. Their usage is now widespread. The compressor motor used in a typical refrigerator is an example of a squirrel cage motor. Michael Faraday discovered electromagnetic induction, the principle by which linear induction motors function, about 250 years ago. Further experiments by pioneers in this field such as Lenz vastly increased the understanding of this phenomenon. Electromagnetism functions within an induction motor when a current is passed through wire coiled around a conductive core (referred to as a motor). When a current is passed through such a coiled wire, the core produces a magnetic field. The direction of this field is dependent upon the direction of the current. The strength of the field is dependent upon the number of windings in the coil as well as the strength of the current.

If a non-ferrous, conductive metal (referred to as a "reaction plate") is introduced into this magnetic field and there is relative motion between the field and the conductor, a current is induced in the conductor. This is known as electromagnetic induction. The induced current will flow within the conductor in a coil-like pattern, thus producing a secondary magnetic field, with the conductor as its core. It is the interaction between these two magnetic fields that creates motion.

A linear induction motor consists of one top 36 and one bottom 36' of a motor bolted into a housing. There is a small air gap (approximately 18 mm in this application) in which the magnetic field produced by the motors is contained. The reaction plate 37 is an aluminum fin attached to the vehicle, as shown in FIG. 12.

When current is supplied to motors 36 and 36', the windings of the motors produce a magnetic field that "appears" to be traveling forward. A second magnetic field is subsequently produced in the reaction plate, and this magnetic field (and hence the reaction plate and drag strip car) attempts to "catch up to" the first field. This effect is similar to moving one magnet on top of a table by using a second magnet on the bottom of the table.

The setup of the windings within the motors greatly effects how the reaction plate behaves. Each setup is dependent upon the estimated speed of the car as it passes through the respective LIM. This system is similar to gears in a transmission. Since the system is similar to gears in a transmission, the shift button 27 can simulate the shifting of gears in a dragster. A series of LIMs are utilized in this particular invention to create a launch time of the dragster through the acceleration area 8.

The actual energy inputs, number of LIMS and LIM assemblies, launch amps and launch volts, as well as programmable launching controller systems are well known in the art and may be adapted to this particular drag strip race by someone with ordinary skill in the art. However, the use of a LIM to propel a drag strip ride for sudden acceleration such as this is new and unique to the amusement ride industry.

It is to be noted that the programmable launching controller system continually monitors the position and velocity of each dragster vehicle as it travels along the acceleration area 8. Each LIM is switched on just before the vehicle enters and is switched off just after the vehicle exits. Once the vehicle reaches the required speed, (a maximum of approximately 250 miles per hour) all LIMs are switched off. The dragster vehicle then coasts through coasting area 9 and into braking area 10. The dragster is decelerated by means of magnetic brakes and a redundant mechanical brake system on the vehicle. The mechanical footbrake also shuts down all LIMS.

The LIM housings used are designed and fabricated to very strict tolerances. The power to each pair of LIM is channeled through dedicated control panels having individual control panels and redundant fuses. Each LIM has three internal thermal protection circuits that will disrupt the power to the motor if it overheats.

Returning now to FIG. 12, the operation of the vehicle in its linear induction mode can be readily ascertained. The vehicle itself has upper frame supports 18 attached to the front 13 and rear 14 of the dragster bodies. The frame 18 is attached to left 19 and right 19' actual wheels, which ride along in a predetermined track. The left 19 and right 19' actual wheels are attached to the lower frame base 35 through the dragster lower base frame-actual wheel connection column 43, as shown on FIG. 12. The actual wheels ride in troughs 44.

In addition to the guide troughs 44 a LIM trough 38 is also provided. This LIM trough 38 houses the linear induction motor utilized to accelerate the dragster as described above. While the simulated wheels 17 ride on the track surface 39, the actual dragster 1 rides on the actual wheels 19. The wheels 19 are accelerated by the linear induction motor 36 and 36' and the reaction plate 37.

The LIM embodiment of this invention is best shown in FIG. 12. However, the below surface embodiment shown in FIG. 12 could be modified such that the actual wheel trough upon which the dragster vehicle 1 rides is above the ground, as shown in FIGS. 8 and 9.

In another embodiment, shown in FIG. 9, the C-shaped steel channeled guide system 32 shown in FIG. 8 is replaced with a guide system that includes a left side rail or pipe 40 and a right side rail or pipe 40'. These left and right circular side rails would be attached in the center of and underneath the dragster 1, as shown. These side rails would be attached to left and right inner walls. However, in order to keep the dragster 1 on its correct path, horizontal 41 and vertical 42 restraining casters would be attached to the dragster frame lower base 35. These restraining casters 41 and 42 are best shown in FIGS. 10 and 10*a*.

As shown in FIGS. 10 and 10*a*, the horizontal 41 and vertical 42 restraining casters are attached alternately to the dragster frame lower base 35. The horizontal restraining casters 41 would keep the dragster vehicle 1 from moving sideways along the linear track. The vertical restraining casters 42 would keep the vehicle from moving up and down in a vertical direction along the track. The side rails and horizontal and vertical casters would be a modification of the steel-channeled guide system 32 as shown in FIG. 8.

One final alternate embodiment of the guide system for the dragster ride is shown in FIG. 11. In this embodiment, the dragster frame lower base 35 is connected to the actual wheel axle 34' by the dragster lower base frame-actual wheel connection column 43 as shown. The linear induction motor system shown at 36 would drive the vehicle as previously noted. However, in this embodiment, the horizontal 41 and vertical 42 restraining casters would be driven along below-surface steel channel guides, as shown. These below surface steel channel guides 45 and 45' are similar to the steel channel guides 32 and 32' shown in FIG. 8.

The dragster 1 also has simulated exhaust smoke, which would be coordinated with the movement of the acceleration pedal by the driver of the vehicle. In addition, the acceleration pedal could be connected and coordinated with real sounds of a drag race through a sound system. The simulated sounds and vibrations of a real drag race are simulated through speakers in each driver's and passenger's helmet.

Another and preferred embodiment of this invention uses pneumatic air pressure to power the racecars down the drag strip. The pneumatic propulsion of the racecars is new to this particular field of simulated drag strips. However, the pneumatic propulsion of amusement rides has previously been disclosed in the art. The patents issued to Checketts, culminating with a 1997 United States patent, disclosed a pneumatic device for accelerating and decelerating objects. This patent, U.S. Pat. No. 5,632,686, was used to develop an oscillating parachute-type ride for amusement parks. The propulsion system described in Checketts disclosed a system of compressed air, a piston, and one or more pulleys, which, when oriented in the horizontal direction, can propel an amusement ride. However, certain modifications and improvements upon the general disclosure and design of the Checketts patent were necessary in order to propel the dual drag strips down the track. In addition, the concept of pneumatic propulsion of this drag strip ride required a new and novel approach to the use of pneumatic power on a flat, side-by-side track.

FIG. 13 discloses the pneumatic propulsion embodiment of this particular invention. The simulated dragster 1 has simulated track wheels 17 that ride on the track surface 46. The dragster 1 is attached to the base sled 47 of the pneumatic embodiment by means of the connecting frame 48. The connecting frame 48 is connected to the pneumatic propulsion mechanism and track to be described later herein.

The pneumatic propulsion mechanism is best shown in FIGS. 14 and 15. As shown on FIG. 15, the actual wheels 19 and 19', which drive the entire mechanism, ride on upper track surfaces 49. These upper track surfaces have an inverted L-shape, as shown on FIGS. 14 and 15. The wheels ride just below the track surface 46 and are connected to each other by axle 50. On one side of one axle is connected an irregularly shaped safety brace 51. This irregularly shaped safety brace is connected to the axle 50 and protrudes beneath the horizontal flange 52 of the actual wheel surface 49. The flange and safety brace interlock such that the dragster 1 is secured from leaving the track in a vertical direction.

In order to ensure that the dragster 1 remains on the track in the horizontal direction, the horizontal safety wheel 53 is also attached to the axle 50. This horizontal safety wheel 53 is mounted in a horizontal orientation as best shown on FIG. 15. Left and right horizontal safety wheel surfaces 54 are located along the length of the drag strip track. The safety wheel is attached to the axle 50 and hence the frame by means of a vertical safety wheel axle 55. The horizontal safety wheel 53 may rotate on axle 55, and allows the dragster 1 to travel down the track without the possibility that the dragster 1 could move or disassociate from the track in the horizontal direction. Since the dragster 1 is prohibited from leaving the track in either the vertical or horizontal direction, the safety of the dragster and the entire ride is thus assured.

The base sled 47 runs on four actual wheels shown best on FIG. 14. The front actual wheels 19 and the rear actual wheels 19' are connected to the base sled 47 in a conventional manner. The base sled has a rectangular perimeter as shown on FIG. 14. This rectangular perimeter includes left and right side rails 56, which run parallel to the track. Horizontal end rails 57 connect the side rails 56. Inner horizontal rails 58 further reinforce the sled.

Figure 2A:
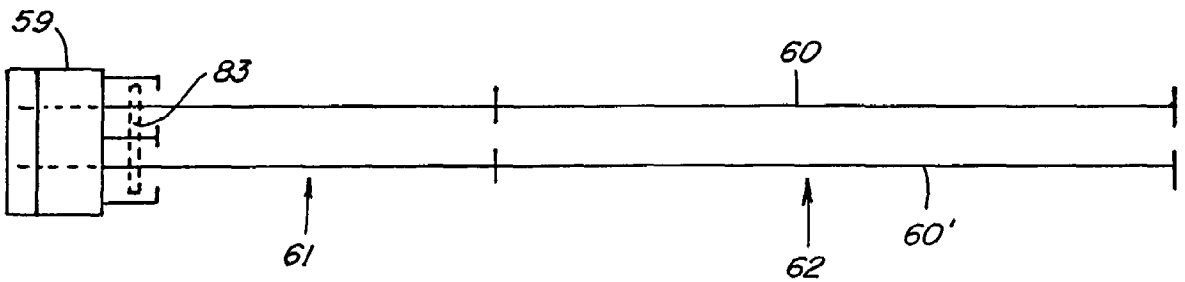
FIG. 2A is a schematic diagram of the drag strip track of the pneumatic embodiment of this invention.

This particular and preferred track is not oval in shape, as shown in the embodiment disclosed in FIG. 2A. Rather, the pneumatic embodiment track of this device is shown in FIG. 2A. The pneumatic embodiment track includes a staging area 59 where participants may position themselves in the vehicle as previously described. The side-by-side tracks 60 and 60' run approximately 600 feet. The 600 feet of track includes an acceleration area 61 of approximately 200 feet and a coasting and deceleration area 62 of approximately 400 feet. Rather than having an oval track where the dragsters move around in a continuous loop, the dragster in this particular embodiment decelerates and then moves in the opposite direction back to staging area 59 after the ride is completed. The propulsion mechanism for acceleration, deceleration and return is described further. The side-by-side tracks 60 and 60' are laid out in a fashion similar to a railroad track, with ties 63 laid along the length of the track to form the foundation for the actual wheel surface 49 and the horizontal wheel safety wheel surfaces 54. The horizontal ties are best shown in FIGS. 14 and 15.

Turning now to the actual propulsion system, the pneumatic acceleration and deceleration system is shown schematically in FIGS. 16 and 16A. In FIG. 16, the pneumatic system is shown in the starting position, while FIG. 16A depicts the pneumatic system as the dragsters complete the drag race but before the dragster is returned to the staging area 59.

Turning specifically to FIG. 16, a schematic of the propulsion system is shown. The propulsion system includes a cylindrical housing 64 that runs the length of the track. This cylindrical housing 64 creates a longitudinal bore 65 that runs parallel to the length of the track, as best shown in FIG. 14. Inside this longitudinal bore 65 is a piston 66. The piston 66 is connected to a cable 67. The lead end 68 of the cable is connected to the front end 69 of the sled. The trailing end 70 of the cable is connected to the rear end 71 as shown in FIGS. 14 and 16. The cable is looped around a starting line pulley 72 and a finish line pulley 73.

The piston 66 is driven by the introduction of compressed air at the starting line end 74 of the cylindrical housing 64. This is shown schematically by the arrow shown at the starting line end of the cylinder housing shown on FIG. 16. The introduction of this air pressure, and its regulation, has previously been described in the prior art, most particularly in the 1997 patent issued to Checketts. While the introduction of air to drive a piston is well known in the art, the particular horizontal and reversible application described herein is a new and novel way to use the propulsion mechanisms previously generally disclosed.

The finish line end 75 of the cylindrical housing 64 is sealed, except for the small aperture required to allow the cable to exit the cylindrical housing.

Each track (60 or 60' shown in FIG. 2A) comprises a pair of cylindrical housings 64. Thus, two longitudinal bores 65 are located directly beneath each track of the drag strip race. Each cylindrical housing 64 contains a piston 66, as best shown in FIG. 16.

The operation of the acceleration and deceleration of the sled is based on the introduction of compressed air into the cylindrical bore 65. As air is introduced at end 74, the piston 66 is driven from left to right on FIG. 16. The movement of the piston 66 from left to right causes the acceleration of the dragster 1 from right to left. As the compressed air is introduced into acceleration chamber portion 76 of the cylindrical housing, the dragster 1 accelerates according to the amount and pressure of the air so introduced. As the dragster 1 moves down the drag strip towards the finish line, the area 76 in the acceleration chamber increases since the piston 66 is now traveling down the bore 65. Ultimately, the acceleration chamber 76 increases such that the natural friction forces of the cable on the pulley and the dragster on the track begin to slow down or decelerate.

As shown in FIG. 16A, as the dragster approaches the finish line, the acceleration chamber 76 is greatly expanded. This change in the acceleration chamber 76 creates a much smaller deceleration chamber 77. Since the acceleration force is now greatly reduced, the sled is naturally slowing down. Further, since the deceleration end 75 of the cylindrical bore 65 is now smaller, the air within the deceleration chamber 77 is greatly compressed. Compression of this air also slows down the movement of the piston 66 from left to right. Eventually, the deceleration chamber compressed air creates a force that reverses the piston 66 such that the piston 66 slides from the position shown in FIG. 16A back to the position shown in FIG. 16. This reverses the direction of the sled 47 so that the sled ends up at the staging area for participants 59. While the acceleration, deceleration and return of the sled are easily accomplished using the introduction of air pressure and the compression of air at the deceleration end of the housing, it is also within the spirit and disclosure of this invention to return the dragster to the staging area by means of the introduction of a small amount of compressed gas to the deceleration chamber 27.

Each track 60 and 60' has a pair of housings 64 with longitudinal bores 65 beneath the track to accelerate, decelerate and return the dragster. The introduction of the air is regulated by a computer, sensor switches, and valves as described previously in the prior art. However, the unique method of providing acceleration for a dragster, and compressing deceleration for the dragster, as well as the intrinsic return mechanism are all new and novel to this art.

As a final refinement of this particular invention, a Christmas tree tower 78 is shown in FIG. 17. This Christmas tree tower 78 is located near the starting line of the dragster race. The tower includes yellow Prestage lights 79, yellow Staging light 80, a set of three yellow Acceleration lights 81 and a set of two green "Go" lights 82. These lights are located near the starting line. A set of lights 79 through 82 is arranged on the Christmas tree for each driver. The Christmas tree thus has a set of lights 79 through 82 on the left side of the tree for the driver in the left lane and a set of lights 79' through 82' for the driver on the right drag strip lane.

In order to enhance the reality of the dragster experience, it would be desirable to simulate the "burn out" of the actual dragster during preparation for the race. The "burn out" period is a period when the dragster driver spins his wheels on the pavement. This creates a loud noise as well as smoke coming from the frictional reactions between the rubber tires of the dragster and the surface. Obviously, in an amusement ride, one would not want to actually spin the simulated tires 17 on the track surface 46. Therefore, a special roller 83 is provided near the starting line to simulate this experience. As the rear wheels 17' of the dragster are located on the roller 83, the simulated wheels 17' are lifted slightly off of the surface 46 on the roller 83. The roller turns rapidly, thus spinning the simulated wheels 17' in an effort that closely simulates the actual "burn out" of a dragster prior to starting the race. Simultaneously with the spinning of the rear wheels, an audio amplification system plays sound effects that simulate the screeching of the tires in the actual "burn out" condition. Also simultaneously smoke is emitted from underneath the track surface 46. The effect of the rear tires spinning, the loud screeching noise and the visual smoke emitted from the track all create a very close simulation of the "burn out" of a dragster.

Audio effects are also arranged along the track such that the occupants of the dragster as well as spectators near the track are able to hear the actual audio effects of a drag race. The screeching of the tires at "burn out", the acceleration of the motor at the starting line, the sound of the motor moving down the track, as well as the deceleration sounds are simulated throughout the ride. These simulations are coordinated by the operator of the ride and by the use of a computer system. The computer system is connected to the audio system and synchronizes the noises of an actual drag race as the race progresses. The audio system is available in speakers along the track as well as in the actual dragster. Thus, the occupants of the dragster as well as the onlookers are treated to the full audio, visual, and actual effects of a drag strip race.

The operation of this second embodiment closely simulates the actual drag strip race, including both audio and visual scenarios. As the rider approaches the staging area 59 for participants, the top of the simulated dragster is opened and the driver and/or passenger is seated. The Y-shaped harness is fastened. The driver is within easy reach of the steering wheel and operational buttons 27 and 27'. The driver of the simulated drag strip begins the ride by pushing the button 27 on the dash, which is the start button. This button then actuates the audio engine idling sound and moves the dragster forward slightly, approximately two feet. As the rear simulated wheels 17' cross the "burn out" roller 83, the rear wheels are rotated by the roller. Simultaneously, the audio simulation of the screeching tires, as well as the simulated smoke emitted from under the track, create the sensory experience of a dragster "burn out".

The simulated dragster then approaches the starting line, moving forward approximately one foot. As the dragster is going through this process, the first yellow or Prestage light 79 on the Christmas tree tower 78 illuminates. The operator of the simulated drag strip then pushes the second yellow Staging button 27'. This activates the staging sound simulation that simulates a motor revving at the starting line of a drag strip race ready to accelerate the dragster down the track.

When both dragsters are at the staging position on the starting line, the operator of the ride will illuminate the three yellow Acceleration lights 81. When these yellow Acceleration lights 81 are illuminated, each driver should push down on the acceleration pedal 25 as quickly as possible to begin the drag race. In this simulation, a computer module allows approximately 0.04 of a second between the times that the three yellow Acceleration lights 81 are illuminated until the time that the two green "Go" lights 82 are illuminated. Once the green Acceleration lights are illuminated, the pneumatic powered system accelerates the dragsters by the introduction of high-pressure compressed air as previously described. The race will be won by the driver who presses the acceleration pedal 25 the fastest. While the acceleration pedal does not in fact allow the driver to accelerate the dragster once the green lights have occurred, since this occurs automatically by the introduction of the compressed air, the initial reaction time of each driver determines the outcome of the race.

In the event a driver depresses the acceleration pedal before the "Go" lights 82 are illuminated, a built-in several second delay from the green light illumination to the pneumatically powered automatic acceleration force is applied to that dragster. This means that a person who defaults the race by depressing the acceleration pedal before he is allowed will actually cross the finish line later in time than the person who correctly depresses the acceleration pedal within the yellow light "Acceleration" time and the green light "Go" time. In a normal race, of course, the dragster that begins the race before the green lights would cross the finish line first, since he has a head start. However, in this simulation, the penalty is applied at the beginning of the race so that the driver who correctly accelerates his vehicle according to the lights will actually cross the simulated finish line first.

While the race is occurring, audio sounds of a typical drag race will be reproduced both by the audio means within each dragster itself and by an audio system located along the length of the track.

Several refinements to this particular system are well within the keeping and disclosure of this invention. For example, the pulleys 72 and 73 may be expandable and may take the form of adjustable shives. These shives would move the outer edges of the pulleys to widen the pulleys or to lessen the distance between the outer edges of the pulleys, thus adjusting for the acceleration of the cable. Furthermore, the apertures necessary to allow the cables to exit either end of the cylindrical bore could be larger or smaller, depending on the specific tolerances necessary to accelerate the dragster. Furthermore, the cables could be nylon-coated cables so that the leakage of the apertures would remain quite minimal.

It is to be appreciated that this device is new and novel as a general concept with respect to amusement rides. Both the creation of the actual physical and visual sensations involved in this drag strip ride, as well as the numerous innovations required to make such a ride safe and realistic have not heretofore been disclosed by any known devices. However, the actual embodiment of this device is meant as a means of illustration only. Minor variations of the appearance of the device, the location and shape of the track, as well as the drive mechanisms is still within the keeping and spirit of this invention. For example, the racetrack could be ¼ mile or longer. Further, a simple bungee cord type of propulsion system or a spring mechanism could replace the described preferred pneumatic system of propelling the vehicle.

What is claimed is:

1. A real-size dragstrip ride, comprising:

(a) at least two simulated dragsters having a front end and a rear end, movably secured to at least two parallel, side-by-side tracks, respectively;

(b) each track having a means to movably constrain each dragster, wherein each dragster remains on its respective track;

(c) at least two cylindrical housings located beneath and parallel to each side-by-side track, respectively, each housing forming a longitudinal bore, each bore having a drive piston therein;

(d) a continuous cable connected to said piston, having one end attached to the front end of said dragster and the other end attached to the rear end of said dragster;

(e) a starting line pulley and a finish line pulley wherein said cable is looped around said pulleys;

(f) a regulated compressed air means for introducing compressed air into said housing cylinders;

(g) a computer system connected to an audio system, said audio system located along said tracks and in said dragster, wherein the actual audio effects of a drag race are simulated as the dragsters move along said tracks in a simulated race;

(h) a starting line signal tower to simulate an actual dragstrip signal tower, said tower including "acceleration" and "go" lights;

(i) a control panel for each of said dragsters, said control panel including a start button for each dragster and an acceleration pedal, wherein pressing said start button begins the ride and wherein depressing said acceleration pedal begins the acceleration of each dragster, respectively;

(j) further comprising a computer module control means having an acceleration delay electronically connected to the acceleration pedal and "acceleration" and "go" lights, wherein the initial acceleration of a dragster is delayed if a driver depresses his respective acceleration pedal before said "go" light is illuminated;

whereby said dragsters are accelerated down said tracks at a speed of approximately 100 miles per hour or greater, by the introduction of compressed air into said housings.

2. A real-size dragstrip ride as in claim 1, further comprising a roller on each of said tracks for spinning the rear tires of each of said dragsters to simulate the visual "burn-out" of the dragster tires, and an audio amplification means to simulate the audible screeching of tires in an actual "burn-out" drag race.

3. A real-sized dragstrip ride as in claim 1, wherein said computer module further allows approximately 0.04 of a second between the times that the "acceleration" and "go" lights are illuminated.

4. A real-sized dragstrip ride as in claim 1, said computer module further comprising a means to delay the acceleration of any dragster whose driver has depressed the acceleration pedal before the "go" lights have been illuminated.

5. A real-sized dragstrip ride as in claim 1, wherein said dragsters are accelerated at speeds to produce approximately of 3.5 Gs of force or greater.

6. A real-size dragstrip ride as in claim 1, said housing cylinders further comprising acceleration and deceleration chambers defined by the movement of the piston along the longitudinal bore of said cylinders, wherein as the dragster moves towards the finish line the deceleration chamber gets smaller, slowing down the movement of the dragster.

7. A real-size dragstrip ride as in claim 1, wherein the direction of travel of said piston may be reversed to return the dragsters to the starting position.

* * * * *